US006929542B1

(12) United States Patent
Stravitz

(10) Patent No.: US 6,929,542 B1
(45) Date of Patent: Aug. 16, 2005

(54) AIR FLOW DEFLECTOR

(76) Inventor: David M. Stravitz, 16 Park Ave., Suite 14A, New York, NY (US) 10016

( * ) Notice: Subject to any disclaimer, the term of this patent is extended or adjusted under 35 U.S.C. 154(b) by 0 days.

(21) Appl. No.: 10/804,633

(22) Filed: Mar. 18, 2004

(51) Int. Cl.[7] ..... F24F 13/06
(52) U.S. Cl. ..... 454/307; 454/304
(58) Field of Search ..... 454/292, 297, 454/304, 307, 217, 218, 220, 226

(56) References Cited

U.S. PATENT DOCUMENTS

| | | | | | |
|---|---|---|---|---|---|
| 903,266 | A | * | 11/1908 | Atkinson | 237/79 |
| 2,051,997 | A | * | 8/1936 | Maynard | 454/220 |
| 2,200,045 | A | * | 5/1940 | Siefken | 454/219 |
| 2,395,848 | A | * | 3/1946 | Clayton, Sr. | 454/226 |
| 2,513,220 | A | * | 6/1950 | Vondruska | 454/226 |
| 4,481,871 | A | | 11/1984 | Efstratis | |
| 4,602,556 | A | | 7/1986 | Gladden | |
| 5,088,540 | A | * | 2/1992 | Harris | 454/220 |
| 5,219,312 | A | | 6/1993 | Smith | |
| 5,312,298 | A | | 5/1994 | Myers | |
| 5,454,755 | A | | 10/1995 | Sweeny et al. | |
| 5,498,203 | A | | 3/1996 | Reichert | |
| 6,050,892 | A | | 4/2000 | Sodec | |
| 2003/0134587 | A1 | | 7/2003 | Hunter | |

* cited by examiner

*Primary Examiner*—Harold Joyce
(74) *Attorney, Agent, or Firm*—Frishauf, Holtz, Goodman & Chick, P.C.

(57) ABSTRACT

Air deflector for deflecting an air flow from an air register including a pair of mounting members adapted to be mounted on opposite sides of a venting member of the air register device and a laterally expandable guide member arranged between the mounting members. The guide member is expandable to different lengths to thereby enable the length between the mounting members to vary and allow the air deflector to be used for different sized air registers. The guide member is pivotally connected to the mounting members and pivotable into different angular positions relative to the mounting members to thereby enable the air flow to be deflected into different directions depending on the angular position of the guide member.

18 Claims, 2 Drawing Sheets

AIR FLOW DEFLECTOR

FIELD OF THE INVENTION

The present invention relates generally to a deflector for changing a direction of an air flow from an air vent or air register and more particularly to a laterally expandable air deflector which is adapted to be mounted over an air register and is capable of deflecting the air flow from the air register into a plurality of different directions.

BACKGROUND OF THE INVENTION

Ventilation systems typically include air conduits and air registers which terminate the conduits and disperse flowing air from the conduits into rooms or other interior environments. The air registers are mounted in the floor, walls or ceiling of the rooms as desired.

Some air registers direct a substantially laminar flow in one direction while others are designed to disperse air in multiple directions. In addition, air registers often include a venting member having louvers that are intended to produce multiple airflow streams in various directions. The louvers themselves are typically flat, planar blades arranged parallel to one another and spaced apart to allow airflow between them, with direction of the air flow being imparted by the angular orientation of the louvers.

Often, the direction or directions of air flow from the air register is not ideal. For example, a couch or bed might be situated in the path of the air flow from a ceiling-mounted air register so that when occupied by a person, the person is impacted by a mildly forceful air flow which is uncomfortable. In addition, a person might sit down in front of a wall-mounted air register and be impacted by the forceful air flow therefrom.

In view of this problem, air deflectors for mounting to an air register have been constructed for the purpose of enabling the direction of the air flow from the air register to be changed. For example, U.S. Pat. No. 4,481,871 (Efstratis) describes an air duct extension unit having a mounting section which is mounted on an air register and a telescoping section which extends laterally from the mounting section. Air from the register is directed through the mounting section and telescoping section and thus, instead of flowing to a space in the room in front of the air duct, the air is directed via the extension unit to a location at a side of the air duct.

In addition, U.S. Pat. No. 5,498,203 (Reichert) describes an air flow deflector having a frame and a guide plate which is movable to any one of three positions to vary the direction of the air flow from the register. The air flow can be directed to a space in front of the register or to one side of the register.

One problem with these prior art air deflectors is that they cannot fit different sized air register. Thus, the air deflectors have to be manufactured in different sizes in order to enable their use with variously sized air registers as existing in the marketplace.

In the prior art, there are also air deflectors arranged in connection with windows to change the direction of the air flow through an opening between the window and the window frame. For example, U.S. Pat. No. 5,454,755 (Sweeny et al.) shows a ventilator for slider-type windows which is retained between a window slider frame and a frame member, i.e., in the opening between the slider frame and the frame member. The ventilator includes slidable or telescoping bridging members which enable the ventilator to have a variable length. One problem with this type of air ventilator is that it only directs the air in a single direction, upward in the disclosed embodiment.

Another prior art air deflector is a plastic vent cover that is designed to mount onto an air register and direct air into a room or other interior environment. This prior art air deflector is adjustable to various widths and is held in place on the air register by magnets.

None of the prior art air deflectors described above is capable of changing the direction of an air flow to any one of a plurality of different directions and also has an adjustable length to enable its use with any size air register or other similar air flow device.

OBJECT AND SUMMARY OF THE INVENTION

It is an object of the present invention to provide a new and improved air deflector for changing a direction of an air flow from an air register or other similar air flow device.

It is another object of the present invention to provide a new and improved air deflector which is expandable to different lengths to enable its use with various sized air registers and similar air flow devices.

It is yet another object of the present invention to provide a new and improved air deflector which is adapted to be mounted over an air register or other similar air flow device and is capable of deflecting the air flow from the air register into a plurality of different directions.

It is still another object of the present invention to provide a new and improved air deflector which is capable of being mounted to conventional air registers in multiple ways.

In order to achieve these objects and others, an air deflector in accordance with the invention includes a pair of mounting members adapted to be mounted on opposite sides of a venting member of an air register or other similar air flow device and a laterally expandable guide member arranged between the mounting members. The guide member is expandable to different lengths to thereby enable the length between the mounting members to vary and allow the air deflector to be used for different sized air registers.

The guide member is pivotally connected to the mounting members and pivotable into a plurality of different angular positions relative to the mounting members to thereby enable the air flow to be deflected into different directions depending on the angular position of the guide member. Moreover, the air flow can be deflected into opposite directions at the same time at various flow rates. Thus, the guide member can have one extreme angular position in which the air flow is deflected entirely to one side of the air register and another extreme angular position in which the air flow is deflected entirely to the other side of the air register. The guide member can be positioned in these extreme positions or at one or more intermediate positions in which the air flow is deflected partially to one side of the air register and partially to the other side of the air register.

To enable its lateral expansion, the guide member includes a plurality of deflecting sections slidable laterally relative to one another. The deflecting sections include one or more outer deflecting sections each defining a channel and one or more inner deflecting sections each partially slidable in the channel of any adjoining outer deflecting sections. An inner deflection section is movable between an extreme position in which it is substantially received within the channel(s) of the adjoining outer deflecting section(s) and an extreme position in which it is only minimally received within the channel(s) of the adjoining outer deflecting section(s).

At a minimum, the guide member includes one outer deflecting section and one inner deflecting section whereby each of these deflecting section is rotatably and directly connected to a respective one of the mounting members.

The deflecting sections are constructed to limit lateral movement thereof relative to one another to thereby maintain the deflecting sections in engagement with one another. This prevents dismemberment of the guide member. For example, a pin can be formed on a surface of each outer deflecting section and a groove formed on a surface of each inner deflecting section and arranged to receive the pin of any adjoining outer deflecting sections.

To pivotally connect the guide member to the mounting members, a pivot pin is attached to each mounting member and engages with the guide member. The pivot pins defines a pivot axis about which the guide member pivots relative to the mounting members. Each pivot pin can pass through an aperture in a respective flange formed on opposite sides of the guide member adjacent the mounting members.

To enable positioning of the guide member in the different angular positions, a detent mechanism is provided. For example, the detent mechanism may constitute a flexible finger formed on the guide member and having a protrusion thereon which is urged into contact with a surface of an adjacent mounting member by the flexible finger. Such a flexible finger could be provided on a flange of the guide member adjacent each mounting member. Optionally, indentations are formed on the surface of the adjoining mounting member so that the protrusion is urged into each indentation by the flexible finger at a respective, different pivoted position of the guide member relative to the mounting members. This introduces a threshold force which must be exceeded before the guide member can be pivoted to a different position.

The mounting members can be attached to the vent frame of the air register and/or to a surrounding substrate, such as a wall, floor or ceiling. Magnets can be arranged in connection with the mounting members for this purpose and/or slots formed in the mounting members through which fasteners such as screws can pass into engagement with the air register or into the substrate surrounding the air register.

Other and further objects, advantages and features of the present invention will be understood by reference to the following specification in conjunction with the annexed drawings, wherein like parts have been given like numbers.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
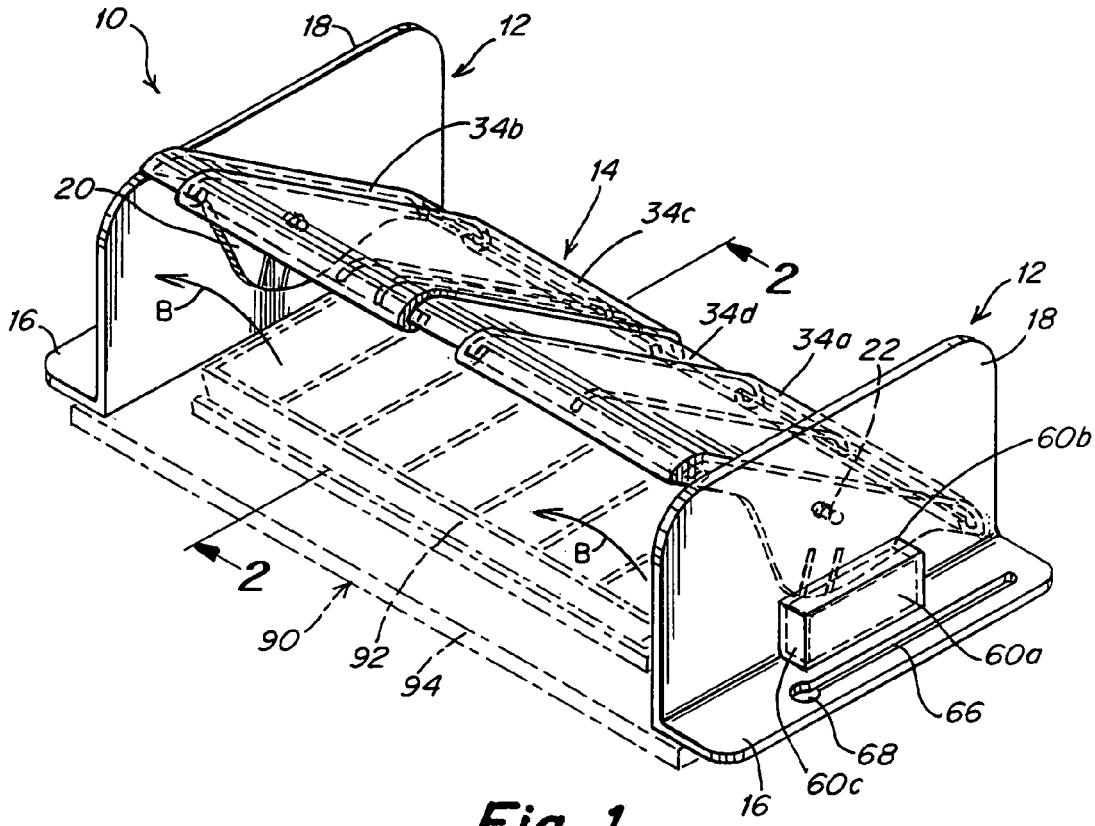
FIG. 1 is a perspective view of an air deflector in accordance with the invention in place on a floor vent.

Referring to the accompanying drawings wherein like reference numerals refer to the same or similar elements, an air deflector in accordance with the invention is shown in FIGS. 1–5 and designated generally as 10. Air deflector 10 comprises a pair of mounting members 12 and a guide member 14 rotatably connected to and arranged between the mounting members 12.

Mounting members 12 are designed to mount the air deflector 10 in place over an air register 90 which terminates an air conduit and includes a venting member 92 surrounded by a metal vent frame 94, and specifically so that the guide member 14 is arranged in the path of the air flow from the venting member 92. Mounting members 12 can be mounted to the metal vent frame 94 surrounding the venting member 92 and/or to a wall, floor or ceiling 96 surrounding the vent frame 94. Mounting members 12 are attached to the vent frame 94 or wall, floor or ceiling 96 on opposite side of the venting member 92 so that the guide member 14 spans and extends across substantially the entire venting member 92.

Mounting members 12 are generally L-shaped, including a horizontal portion 16 which is adapted to be placed against and preferably in contact with the substrate to which the mounting member 12 is attached, i.e., the vent frame 94 and/or wall, floor or ceiling 96, and a vertical portion 18 extending substantially perpendicular to the horizontal portion 16. When installed in connection with the air register 90, the horizontal portion 16 is situated generally parallel to the outer surface of the vent frame 94 and outer surface of the wall, floor or ceiling 96. Reinforcement ribs may optionally be provided between the upper surface of the horizontal portion 16 and the outer surface of the vertical portion 18.

The guide member 14 is rotatably mounted to the vertical portions 18 of the mounting members 12. To this end, guide member 14 includes a flange 20 formed at each end and a pivot pin 22 is attached to the vertical portion 18 of each mounting member 12 and arranged to pass through an aperture 24 in a respective flange 20. The pivot pins 22 define a pivot axis about which the guide member 14 pivots relative to the mounting members 12. The pivot pins 22 may be in the form of a split-flared head, snap-fit hinge assembly and may pass through an aperture in the vertical portions 18 of the mounting members 12 as well. An optional washer 26 is interposed between the vertical portion 18 of each mounting member 12 and the respective flange 20 of the guide member 14 (see FIG. 3).

Guide member 14 is mounted to the mounting members 12 to enable it to be positioned and maintained in any one of a plurality of different angular, pivoted positions. In one extreme angular position, a front edge of the guide member 14 is close to and possibly even in contact with the venting member 92 (see the guide member 14 shown in phantom lines in FIG. 2). In this position, the guide member 14 directs all of the air from the air register 90 in a rearward direction (arrows A1 and A2 in FIG. 2). In an opposite extreme position, a rear edge of the guide member 14 is close to and possibly in contact with the venting member 92 (see the guide member 14 shown in FIG. 1). In this position, the guide member 14 directs all of the air from the air register 90 in a forward direction (arrows B in FIGS. 1 and 2). In an intermediate position shown in solid lines in FIG. 2, the guide member 14 is substantially parallel to the outer face of the venting member 92 and directs the air from the air register 90 both in a forward direction and in a rearward direction (arrows A2 and B in FIG. 2). Additional intermediate positions between the extreme positions are also possible.

To provide for the positioning of the guide member 14 in the different angular, pivoted positions, a detent mechanism is provided. The detent mechanism includes a flexible finger 28 formed on one or both flanges 20 of the guide member 14 and having a protrusion 30 thereon, e.g., a protrusion in the form of a hemispherical bump. The protrusion 30 is urged by the finger 28 against an opposed surface of the adjacent mounting member 12, e.g., the inner surface of the vertical portion 18 of the mounting member 16, to frictionally engage the mounting member 12. Optionally, a plurality of dimples or indentations 32 are formed in the inner surface 34 of the vertical portion 18 of each mounting member 12 such that the protrusion 30 is capable of entering into each indentation 32 at a different pivoted position of the guide member 14 relative to the mounting members 12.

Manual pivoting of the guide member 14 causes the flexible finger 28 to flex inward and the protrusion 30 is thereby moved along the surface of the vertical portion 18 of the mounting member 12 and when the indentations 32 are present, from one indentation 32 to another. When the indentations 32 are not present, the guide member 14 is more easily moved between the angular positions and a large number of intermediate positions are possible. When the indentations 32 are present, the number of different angular positions of the guide member 14 is essentially limited by the number of indentations 32.

The guide member 14 is also designed to enable the air deflector 10 to be used with a plurality of different sized air registers 90. To this end, the guide member 14 is formed from a plurality of deflecting sections 34*a*, 34*b*, 34*c*, 34*d* which are slidable laterally relative to one another to enable the guide member 14 to have a variable length. At a minimum, the guide member 14 includes two deflecting sections, namely, an outer end deflecting section 34*a* and an inner end deflecting section 34*b*. Outer end deflecting section 34*a* is formed in connection with the flange 20 and defines a channel 36 on an underside into which the inner end deflecting section 34*b* can slide. The channel 36 is defined by an substantially planar wall 38, front and rear curved walls 40 and front and rear inwardly directed lips 42 (see FIG. 2). Inner end deflecting section 34*b* is also formed in connection with a flange 20 and includes a substantially planar wall 44 and front and rear curved walls 46. When the inner end deflecting section 34*b* slides into the outer end deflecting section 34*a*, the wall 44 slides along the wall 38 while the curved walls 46 slide between the curved walls 40 and the lips 42 (see FIG. 2).

In the non-limiting illustrated embodiment, the flanges 20 extend substantially perpendicular to the deflection portions of the end deflecting sections 34*a*, 34*b*, i.e., the planar walls 38 or 44, so that the guide member 14 is substantially perpendicular to the vertical portions 18 of the mounting members 12.

To enable the inner end deflecting section 34*b* to be maintained in connection with the outer end deflecting section 34*a*, a pin 48 is formed on the bottom surface of the planar wall 38 of the outer end deflecting section 34*a* on a lateral side opposite to the flange 20 and a groove 50 is formed in the top surface of the planar wall 44 of the inner end deflecting section 34*b*. The groove 50 does not extend fully to the lateral edges of the inner end deflecting section 34*b*. The pin 48 enters into the groove 50 and slides therein when the outer and inner end deflecting sections 34*a*, 34*b* slide relative to one another to vary the length of the guide member 14. Thus, separation of the outer and inner end deflecting sections 34*a*, 34*b* from one another would be prevented.

Other constructions for limiting the lateral movement of the deflecting sections 34*a*, 34*b* relative to one another to thereby maintain the deflecting sections 34*a*, 34*b* in engagement with one another are also possible. For example, one construction could be locating the pin 48 and groove 50 in connection with the curved walls 40, 46. Also, instead of grooves, slots could be formed.

Figure 3:
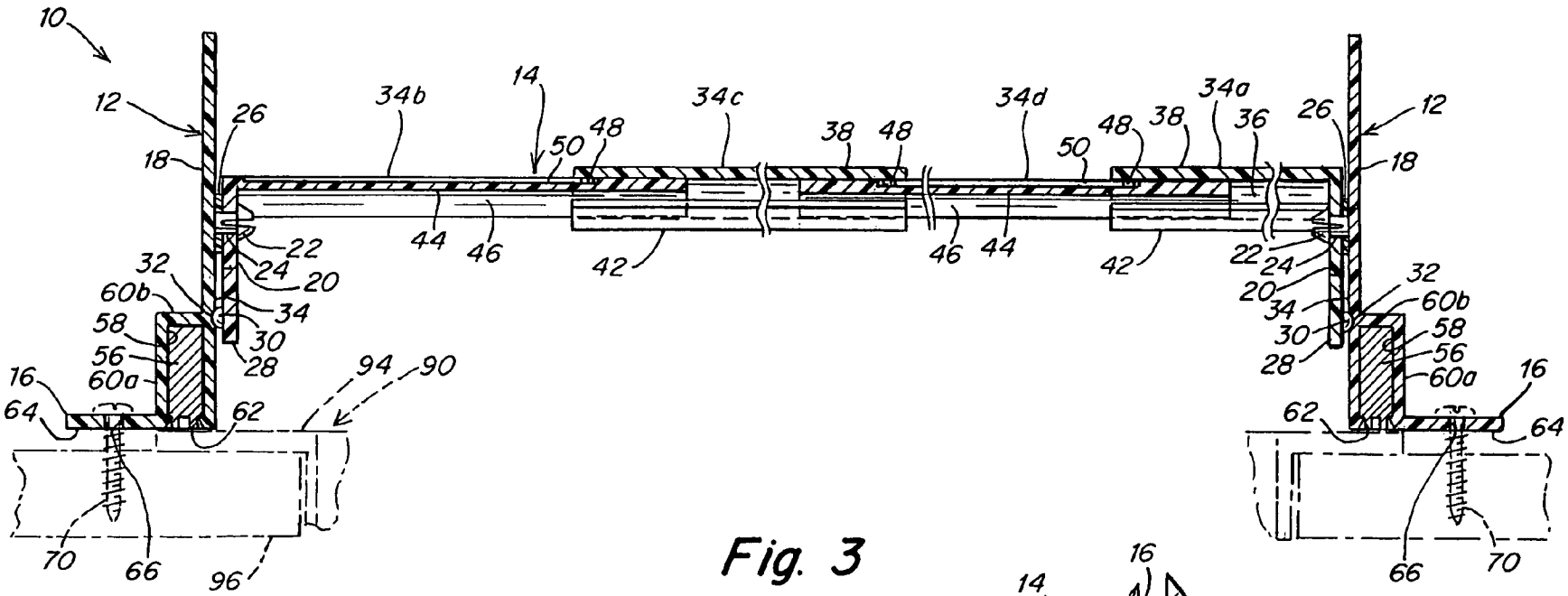
FIG. 3 is a cross-sectional side view of the air deflector shown in FIG. 1 taken along the line 3—3 of FIG. 2.
Figure 5:
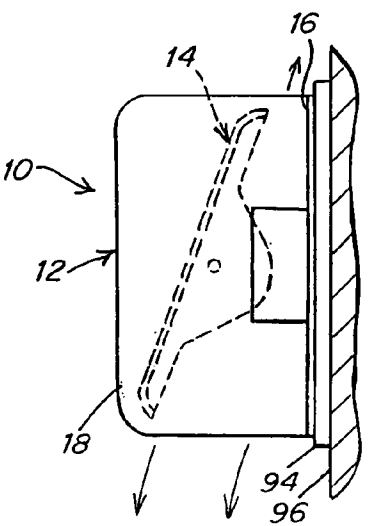
FIG. 5 is a schematic end view of the air deflector shown in FIG. 1 used in conjunction with a wall-mounted air register.
Figure 4:
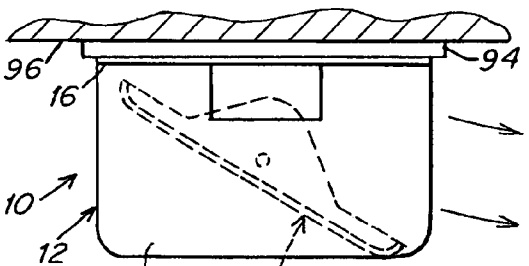
FIG. 4 is a schematic end view of the air deflector shown in FIG. 1 used in conjunction with a ceiling-mounted air register.

In the illustrated embodiment, there are two additional intermediate deflecting sections to increase the largest possible length of the guide member 14, an outer intermediate deflecting section 34*c* connected to the inner end deflecting section 34*b* and an inner intermediate deflecting section 34*d* connected to the outer end deflecting section 34*a* and to the outer intermediate deflecting section 34*c* (see FIG. 3). Outer intermediate deflecting section 34*c* defines a channel 36 on an underside into which the inner end deflecting section 34*b* and the inner intermediate deflecting section 34*d* slide. The channel 36 is defined by an substantially planar wall 38, front and rear curved walls 40 and front and rear inwardly directed lips 42. A pin 48 is formed on the bottom surface of the planar wall 38 of the outer intermediate deflecting section 34*c* along each lateral side. Inner intermediate deflecting section 34*d* includes a substantially planar wall 44 and front and rear curved walls 46. A groove 50 is formed in the top surface of the planar wall 44 of the inner intermediate deflecting section 34*b*.

As shown in FIG. 3, the inner end deflecting section 34*b* and the inner intermediate deflecting section 34*d* slide into the channel 36 in the outer intermediate deflecting section 34*c* while the inner intermediate deflecting section 34*d* also slides into the channel 36 in the outer end deflecting section 34*a*. The pins 48 and grooves 50 serve to maintain the deflecting sections 34*a*, 34*b*, 34*c*, 34*d* in connection with one another while enabling the deflecting sections 34*a*, 34*b*, 34*c*, 34*d* to slide relative to one another to vary the length of the guide member 14.

Instead of forming channels 36 in the outer deflecting sections 34*a*, 34*c*, an alternative manner to provide for slidable engagement of the inner and outer deflecting sections is to form the outer deflecting sections with only a planar wall and front and rear curved wall and the inner deflecting sections with a planar wall, front and rear curved wall and an outwardly directed lip whereby the front and rear curved walls of the outer deflecting sections slide in channels defined by the front and rear curved walls and outwardly directed lips of the inner deflecting sections. Other ways for enabling slidable engagement of the inner and outer deflecting sections, such as a telescoping construction, are also considered to be within the scope and spirit of the invention.

The length of the guide member 14 can be further increased by inserting additional pairs of an inner intermediate deflecting section and an outer intermediate deflecting sections, while maintaining the alternating sequence of an inner deflecting section and an outer deflecting section. Depending on the length of each deflecting section, there may be from 2 to 8 deflecting section in the guide member 14. If smaller deflecting sections are used, then the number of deflecting sections would be higher than when larger deflecting sections are used (in order to provide for the same maximum length of the guide member 14).

In alternative constructions of the guide member 14, it is also possible to provide two outer end deflecting sections with a single inner intermediate deflecting section, or two inner end deflecting sections with a single outer intermediate deflecting section. For these embodiments, it is possible to increase the length of the guide member 14 by adding one or more pairs of an inner intermediate deflecting section and an outer intermediate deflecting section.

There are various ways to attach the mounting members 12 to the vent frame 94 and/or wall, floor or ceiling 96. In the illustrated embodiment, a magnet 56 is arranged in a cavity 58 formed on the mounting member 12 outward of the vertical portion 18 and extending upward from an opening 62 in the horizontal portion 16. Enclosure walls 60 are formed to define the cavity 20 and include a side wall 60*a* parallel to the vertical portion 18 and spaced outward therefrom, a top wall 60*b* parallel to the horizontal portion 16 and spaced upward therefrom and side walls 60*c* extending perpendicular to the horizontal and vertical portions 16, 18. The magnets 56 may be constructed to provide opposite poles which are flush with the lower horizontal edge 64 of the horizontal portion 16 (see FIG. 3).

The magnet 56 in each mounting member 12 serves to enable magnetic attraction of the mounting member 12 to the metal vent frame 94 on a respective side of the venting member 92. Using magnetic forces, the air deflector 10 can be easily attached and removed from connection with the air register 90 simply by placing the magnets 56 into engagement with the metal vent frame 92. The size and strength of the magnets 56 should be set such that when the air deflector 10 is mounted on a wall or ceiling and air passes through the air register 90 with a typical force, the combined effect of the magnets 56 interacting with the metal vent frame 94 is capable of holding the air deflector 10 firmly in position.

A construction of an air deflector 10 in accordance with the invention is also envisioned in which magnets 56 are not used so that the cavity 58, enclosure walls 60 and opening 62 are not present. An alternative attachment mechanism for attaching the mounting members 12 to the vent frame 94 or wall, floor or ceiling 96 is thus provided.

One attachment mechanism for attaching the mounting members 12 to the wall, floor or ceiling 96 is the formation of an elongate slot 66 in the horizontal portion 16. Slot 66 has an enlarged end 68 through which the head of a screw 70 can pass (see FIG. 1). Instead of screws 70, other elongate fasteners can be used, such as nails. To mount the air deflector 10 using slots 66, screws 70 are screwed or drilled into the wall, floor or ceiling 96, and then the air deflector 10 is placed onto the screws 70 by aligning the end 68 of the slot 66 over the screws 70 until the air deflector 10 is flush against the wall, floor or ceiling 96. The mounting members 12 can be moved upward or downward such that the screws 70 slide in the slots 66 until a desired position of the air deflector 10 relative to the venting member 92 is obtained. The screws 70 are tightened to press the horizontal portions 16 against the wall, floor or ceiling 96.

Alternatively, it is possible to mount the screws 70 into the wall, floor or ceiling 96 such that the air deflector 10 is in the desired position when the screws 70 are at the end of the slots 66 opposite the enlarged end 68. When this technique is used for a wall-mounted air register, the air deflector 10 would remain in position by the effect of gravity and removing it would entail lifting it upward until the ends 68 of the slots 66 align with the screws 70 and then pulling the air deflector 10 away from the wall 96.

If attachment to a wall, floor or ceiling 96 surrounding the air register 90 is desired, and not attachment to the metal vent frame 94 of the air register 90, it is possible to provide the slots 66 in the horizontal portions 16 of the mounting members 12 without the cavities 58 receiving the magnets 56. The mounting members 12 could thus have a simple L-shaped configuration.

Other attachment mechanisms for attaching the mounting members 12 to the metal vent frame 94 or to the wall, floor or ceiling 96 include holes formed in the horizontal portion 16 through which screws or nails can be passed as well as various adhesives which may be placed on the lower surface of the horizontal portion 16 of the mounting members 12.

Another attachment mechanism is designed to use the holes through which screws pass to mount the vent frame 94 to a substructure of the air register 90. In this case, holes or slots are formed on the horizontal portion 16 of the mounting members 12 in alignment with the location of the holes for the screws which mount the vent frame 94. Screws can then be passed through the holes in the mounting members 12 and the aligning holes in the metal vent to both fix the air deflector to the metal frame 94 and the metal frame 94 to the substructure. This type of attachment save materials and provides a clean-looking installation by eliminating the need to make new holes in the wall, floor or ceiling.

Figure 2:
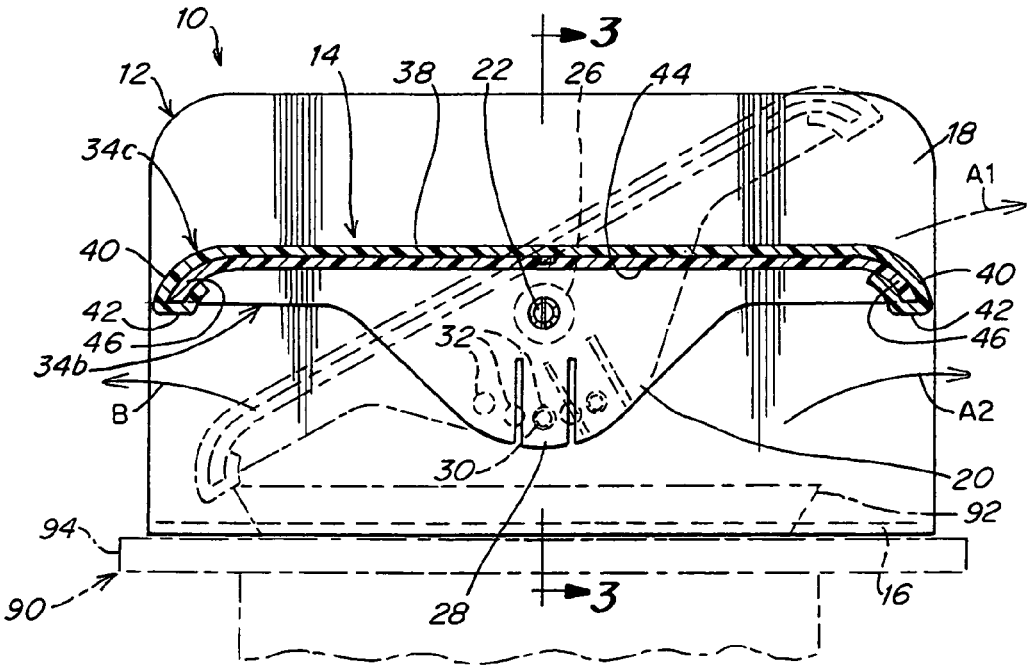
FIG. 2 is a cross-sectional end view of the air deflector shown in FIG. 1 taken along the line 2—2 of FIG. 1.

The width of the guide member 14 is preferably sufficient to enable the guide member 14 to be situated entirely in the part of a straight outward air flow from the venting member 92 of the air register 90 regardless of the angular position of the guide member 14 (see FIG. 2 wherein the guide member 14 in both solid lines and phantom lines overlies the entire venting member 92). The guide member 14 can thus be dimensioned to contact the venting member 92 when at each of its extreme positions or can be dimensioned to contact the vent frame 94 when at each of its extreme positions.

In use to place the air deflector 10 over an air register 90, the mounting members 12 are pulled apart from one another until the length of the guide member 14 approximates the length of the venting member 92. The horizontal portions 16 of the mounting members 12 are then placed onto the vent frame 94, and if the vent frame is magnetic and magnets 56 are provided in the mounting members 12, then the air deflector 10 is attached to the air register 90. The guide member 14 can then be pivoted into different angular positions relative to the mounting members 12 such that it deflects the air flow from the air register 90 entirely to one side, entirely to the opposite side or partially to each side.

Pivoting of the guide member 14 is achieved by pushing an edge of the guide member 14 separated from the air register 90 toward the air register 90, or by lifting an edge of the guide member 14 away from the air register 90.

In addition to the magnetic mounting of the air deflector 10 to the vent frame 94, or when magnets 56 are not provided or the vent frame 94 is not magnetic, screws 70 can be mounted onto the wall, floor or ceiling 96 around the vent frame 94 with a small distance remaining between the head of the screws 70 and the wall, floor or ceiling 96. The air deflector 10 is placed onto the screws 70 by aligning the enlarged end 68 of the slot 66 over the screws 70 until the air deflector 10 is flush against the wall, floor or ceiling 96 with the horizontal portion 16 of each mounting members 12 being between the head of a respective screw 70 and the wall, floor or ceiling 96. The mounting members 12 are then moved upward or downward such that the screws 70 slide in the slots 66 until a desired position of the air deflector 10 relative to the venting member 92 is obtained. At this point, the screws 70 are tightened to press the horizontal portions 16 against the wall, floor or ceiling 96. Removal of the air deflector 10 requires loosening of the screws 70, sliding of the mounting members 12 relative to the screws 70 until the enlarged ends 68 align with the screws 70 and then pulling the mounting members 12 away from the air register 90.

While the invention has been described above with respect to specific apparatus and specific implementations, it should be clear that various modifications and alterations can be made, and various features of one embodiment can be included in other embodiments, within the scope of the present invention. For example, although the air deflector is described above generally for use with a wall-mounted, floor-mounted or ceiling-mounted air register, it is also possible to use the air deflector for deflecting air flows which do not emanate from such air registers.

I claim:

1. An deflector for deflecting an air flow, comprising:

a pair of mounting members; and a guide member arranged between said mounting members and having an adjustable length to thereby enable a length between said mounting members to vary;

said guide member being pivotally connected to said mounting members to enable said guide member to be pivoted into a plurality of different angular positions relative to said mounting members to thereby enable the air flow to be deflected into different directions depending on the angular position of said guide member.

2. The deflector of claim 1, wherein said guide member comprises a plurality of deflecting sections slidable laterally relative to one another to enable the length of said guide member to be adjustable.

3. The deflector of claim 2, wherein said deflecting sections include at least one outer deflecting section defining a channel and at least one inner deflecting section partially slidable in said channel of any adjoining ones of said at least one outer deflecting section.

4. The deflector of claim 3, wherein said guide member includes limiting means for limiting lateral movement of said deflecting sections relative to one another to thereby maintain said deflecting sections in engagement with one another.

5. The deflector of claim 4, wherein said limiting means comprise a pin formed on a surface of each of said at least one outer deflecting section and a groove formed on a surface of each of said at least one inner deflecting section and arranged to receive said pin of any adjoining ones of said at least one outer deflecting section.

6. The deflector of claim 2, wherein said deflecting sections include an outer end deflecting section defining a channel, an outer intermediate deflecting section defining a channel, an inner intermediate deflecting section partially slidable in said channels of said outer end deflecting section and said outer intermediate deflecting section, and an inner end deflecting section partially slidable in said channel of said outer intermediate deflecting section, said inner and outer end deflecting sections being connected to a respective one of said mounting members.

7. The deflector of claim 6, wherein said inner and outer end deflection sections each include a substantially planar deflection portion and a flange extending perpendicular to said planar deflection portion, said flange being connected to said mounting members.

8. The deflector of claim 1, further comprising positioning means for positioning said guide member in the different angular positions.

9. The deflector of claim 8, wherein said positioning means comprise a detent mechanism.

10. The deflector of claim 8, wherein said positioning means comprise at least one flexible finger formed on said guide member opposite a surface of a respective one of said mounting members and having a protrusion thereon, said protrusions being urged into contact with said surface of said respective mounting member by said flexible finger.

11. The deflector of claim 10, wherein said positioning means further comprise indentations formed on said surface of said mounting members, said protrusions being urged into each of said indentations by said flexible finger at a respective, different pivoted position of said guide member relative to said mounting members.

12. The deflector of claim 1, wherein said mounting members include attachment means for attaching said mounting members to an air register.

13. The deflector of claim 12, wherein said attachment means comprise magnets arranged in connection with said mounting members for attaching said mounting members to a metal vent frame of the air register.

14. The deflector of claim 12, wherein said attachment means comprise slots formed in said mounting members through which fasteners pass into engagement with the air register or into a substrate surrounding the air register.

15. The deflector of claim 1, wherein said mounting members are substantially L-shaped and include a horizontal portion adapted to be placed against an air register and a vertical portion extending substantially perpendicular to said horizontal portion, said guide member being rotatably mounted to said vertical portions of said mounting members.

16. The deflector of claim 1, further comprising mounting means for pivotally mounting said guide member to said mounting members.

17. The deflector of claim 16, wherein said mounting means comprise a pivot pin attached to each of said mounting members and engaging with said guide member, said pivot pins defining a pivot axis about which said guide member pivots relative to said mounting members.

18. The deflector of claim 17, wherein said guide member includes flanges on opposite sides adjacent said mounting members, each of said pivot pins being arranged to pass through an aperture in a respective one of said flanges.

* * * * *